US010577170B2

(12) United States Patent
Balicki et al.

(10) Patent No.: US 10,577,170 B2
(45) Date of Patent: Mar. 3, 2020

(54) POINT OF SERVICE COATING MIXING AND DELIVERY KIT AND METHOD

(71) Applicants: Kevin John Balicki, Rock Hill, SC (US); Andrew Tipton Lewis, Rock Hill, SC (US); Thomas Emanuel Widmer, Rock Hill, SC (US)

(72) Inventors: Kevin John Balicki, Rock Hill, SC (US); Andrew Tipton Lewis, Rock Hill, SC (US); Thomas Emanuel Widmer, Rock Hill, SC (US)

(73) Assignee: SEM Products, Inc., Rock Hill, SC (US)

( * ) Notice: Subject to any disclaimer, the term of this patent is extended or adjusted under 35 U.S.C. 154(b) by 179 days.

(21) Appl. No.: 15/782,095

(22) Filed: Oct. 12, 2017

(65) Prior Publication Data

US 2019/0112122 A1 Apr. 18, 2019

(51) Int. Cl.

| | |
|---|---|
| ***B65D 83/42*** | (2006.01) |
| ***B01F 15/00*** | (2006.01) |
| ***B05B 7/00*** | (2006.01) |
| ***B01F 15/02*** | (2006.01) |
| ***A47B 47/02*** | (2006.01) |
| ***A47F 5/01*** | (2006.01) |
| ***A47F 7/28*** | (2006.01) |
| *B01F 13/00* | (2006.01) |

(52) U.S. Cl.

CPC ..... *B65D 83/42* (2013.01); *A47B 47/021* (2013.01); *A47F 5/01* (2013.01); *A47F 7/28* (2013.01); *B01F 15/00772* (2013.01); *B01F 15/0201* (2013.01); *B05B 7/0093* (2013.01); *B01F 13/0018* (2013.01); *B01F 2215/005* (2013.01)

(58) Field of Classification Search

CPC ..... B65D 83/42; B01F 15/00772; B01F 15/0201; B01F 15/0203; B01F 13/0018; B01F 2215/005; B05B 7/0093

USPC ..... 141/3, 20, 144–148

See application file for complete search history.

(56) References Cited

U.S. PATENT DOCUMENTS

| | | | | | |
|---|---|---|---|---|---|
| 3,878,907 | A * | 4/1975 | Morick | B01F 13/1058 | 177/70 |
| 3,908,563 | A * | 9/1975 | Eckart, Jr. | A47F 5/0043 | 108/77 |
| 4,192,362 | A * | 3/1980 | Achen | B44D 3/003 | 141/177 |
| 5,119,973 | A * | 6/1992 | Miller | B01F 13/1055 | 141/104 |
| 5,160,198 | A * | 11/1992 | Fillon | B01F 7/1695 | 366/198 |

(Continued)

*Primary Examiner* — Timothy L Maust

(74) *Attorney, Agent, or Firm* — Clements Bernard Walker; Christopher L. Bernard

(57) ABSTRACT

A paint and coating mixing kit, comprising: a shelf assembly; a plurality of aerosol blank cans disposed on the shelf assembly; a plurality of paint or coating cans or bottles disposed on the shelf assembly; and a filling assembly disposed on the shelf assembly; wherein the filling assembly is operable for selectively delivering a paint or coating from one of the plurality of paint or coating cans or bottles to one of the plurality of aerosol blank cans at a point of service location such that the paint or coating may be delivered in spray form from the aerosol blank can to an object to be painted or coated at the point of service location.

11 Claims, 2 Drawing Sheets

(56) References Cited

U.S. PATENT DOCUMENTS

| | | | | |
|---|---|---|---|---|
| 5,493,840 | A * | 2/1996 | Cane | B01F 13/1055 53/50 |
| 6,543,490 | B1 * | 4/2003 | Owens | B01F 13/1055 141/20 |
| 7,000,650 | B2 * | 2/2006 | Desjardins | B65B 3/12 141/20 |
| 7,343,941 | B2 * | 3/2008 | Heatley | B01F 13/1055 141/104 |
| 7,865,264 | B2 * | 1/2011 | Hughes | G05D 11/132 141/1 |
| 8,141,597 | B2 * | 3/2012 | Chassaing | B65B 31/003 141/20 |
| 8,141,600 | B2 * | 3/2012 | Khoo | B44D 3/08 141/102 |
| 8,584,712 | B2 * | 11/2013 | Ballu | B05B 5/1633 141/3 |
| 8,752,594 | B2 * | 6/2014 | Gebhard | B01F 13/1061 141/11 |
| 8,844,584 | B1 * | 9/2014 | Haley | B65B 31/003 141/20 |
| 8,985,163 | B2 * | 3/2015 | Heatley | B65B 31/003 141/20 |
| 2004/0154202 | A1 * | 8/2004 | Gibson | G09F 7/22 40/617 |
| 2009/0038708 | A1 * | 2/2009 | Hirz | B65B 31/003 141/3 |

* cited by examiner

POINT OF SERVICE COATING MIXING AND DELIVERY KIT AND METHOD

FIELD OF THE INVENTION

The present invention relates generally to a point of service coating mixing and delivery kit and method for mixing and providing aerosolized paints and the like in an automobile collision center, fleet service center, or the like, thereby eliminating the need to purchase pre-mixed aerosolized paints and the like with a limited shelf life, and the need to mix such paints and the like in messy cups and deliver them via a spray gun or the like. This frees up works and promotes workplace efficiency. This also provides the ability for a repair technician to put their preferred brand of paint, catalyzed or non-catalyzed, into an aerosol can at the point of service.

BACKGROUND OF THE INVENTION

In an automobile collision center or fleet service center, for example, paints and other coatings are typically applied from pre-mixed aerosolized paint cans. Alternatively, a preferred basecoat, primer, or clear is typically mixed with a given activator in cups and then delivered via spray gun or the like. The former approach is problematic as pre-mixed aerosolized paint cans have a limited shelf life, much of which may already be exhausted when a given product is purchased by the automobile collision center. The latter approach is problematic as cups are costly and messy, product is wasted, spray guns must be cleaned, and hazardous waste is generated. Thus, what is still needed in the art is a improved approach for obtaining and handling such paints and other coatings in an automobile collision center or the like. No such approach is currently known or exists. There are currently aerosol cans pre-loaded with a "close enough" hardner (activator) on the market, but none that allow the hardner (activator) and product to be introduced into an aerosol can simultaneously at the point of service.

BRIEF SUMMARY OF THE INVENTION

In various exemplary embodiments, the present invention provides a point of service coating mixing and delivery kit and method. The kit includes a shelf assembly on which aerosol blank cans, paint and coating cans or bottles, and a manual or pneumatic filling assembly are disposed. The shelf assembly may be modular and is provided with locking casters or wheels such that it may be moved from place to place in the shop. It may include hooks or receptacles for towels, trash cans, and the like. The aerosol blank cans are filled with a propellant and mixing marble (and optionally other universal paint or coating components) and include a chosen spray tip and a cap. The paint and coating cans or bottles may include any combination of desired paints, primers, coatings, clearcoats, catalysts, activators, reducers, etc., whether water or solvent based, that are to be disposed in the aerosol blank cans onsite using the manual or pneumatic filling assembly. The filling assembly includes a rigid housing defining an opening in which one of the aerosol blank cans is selectively disposed, minus the spray tip and cap. A filling cylinder or the like filled with the desired paint or coating component(s) is also selectively disposed within or coupled to the rigid housing in fluid communication with the aerosol blank can. The filling assembly, which is operated manually or coupled to an attached compressor (either proximate or remote), is actuated and injects the desired paint or coating into the aerosol blank can, which may then be removed and used in the shop in a conventional procedurally compliant manner. This filling process may consist of one step or multiple steps. This allows for the point of service provision of ready-to-use aerosolized paints and coatings, with mitigated concerns related to spoilage or mess.

In one exemplary embodiment, the present invention provides a paint and coating mixing kit, comprising: a shelf assembly; a plurality of aerosol blank cans disposed on the shelf assembly; a plurality of paint or coating cans or bottles disposed on the shelf assembly; and a filling assembly disposed on the shelf assembly; wherein the filling assembly is operable for selectively delivering a paint or coating from one of the plurality of paint or coating cans or bottles to one of the plurality of aerosol blank cans at a point of service location such that the paint or coating may be delivered in spray form from the aerosol blank can to an object to be painted or coated at the point of service location. The shelf assembly comprises wheels or casters for allowing the shelf assembly to move. The plurality of aerosol blank can are configured to receive one of a water based paint or coating and a solvent based paint or coating. The plurality of paint or coating cans or bottles comprise one or more components of one of a water based paint or coating and a solvent based paint or coating. The filling assembly comprises one of a manual filling assembly and a pneumatic assembly. The pneumatic filling assembly comprises a coupled compressor operable for actuating the pneumatic filling assembly.

In another exemplary embodiment, the present invention provides a method for providing a paint and coating mixing kit, comprising: providing a shelf assembly; providing a plurality of aerosol blank cans disposed on the shelf assembly; providing a plurality of paint or coating cans or bottles disposed on the shelf assembly; and providing a filling assembly disposed on the shelf assembly; wherein the filling assembly is operable for selectively delivering a paint or coating from one of the plurality of paint or coating cans or bottles to one of the plurality of aerosol blank cans at a point of service location such that the paint or coating may be delivered in spray form from the aerosol blank can to an object to be painted or coated at the point of service location. The shelf assembly comprises wheels or casters for allowing the shelf assembly to move. The plurality of aerosol blank can are configured to receive one of a water based paint or coating and a solvent based paint or coating. The plurality of paint or coating cans or bottles comprise one or more components of one of a water based paint or coating and a solvent based paint or coating. The filling assembly comprises one of a manual filling assembly and a pneumatic assembly. The pneumatic filling assembly comprises a coupled compressor operable for actuating the pneumatic filling assembly. The method further comprises shipping the shelf assembly, the plurality of aerosol blank cans, the plurality of paint or coating cans or bottles, and the filling assembly to a user together in one or more boxes.

BRIEF DESCRIPTION OF THE DRAWINGS

The present invention is illustrated and described herein with reference to the various drawings, in which like reference numbers are used to denote like kit components/method steps, as appropriate, and in which.

DETAILED DESCRIPTION OF THE INVENTION

Figure 1:
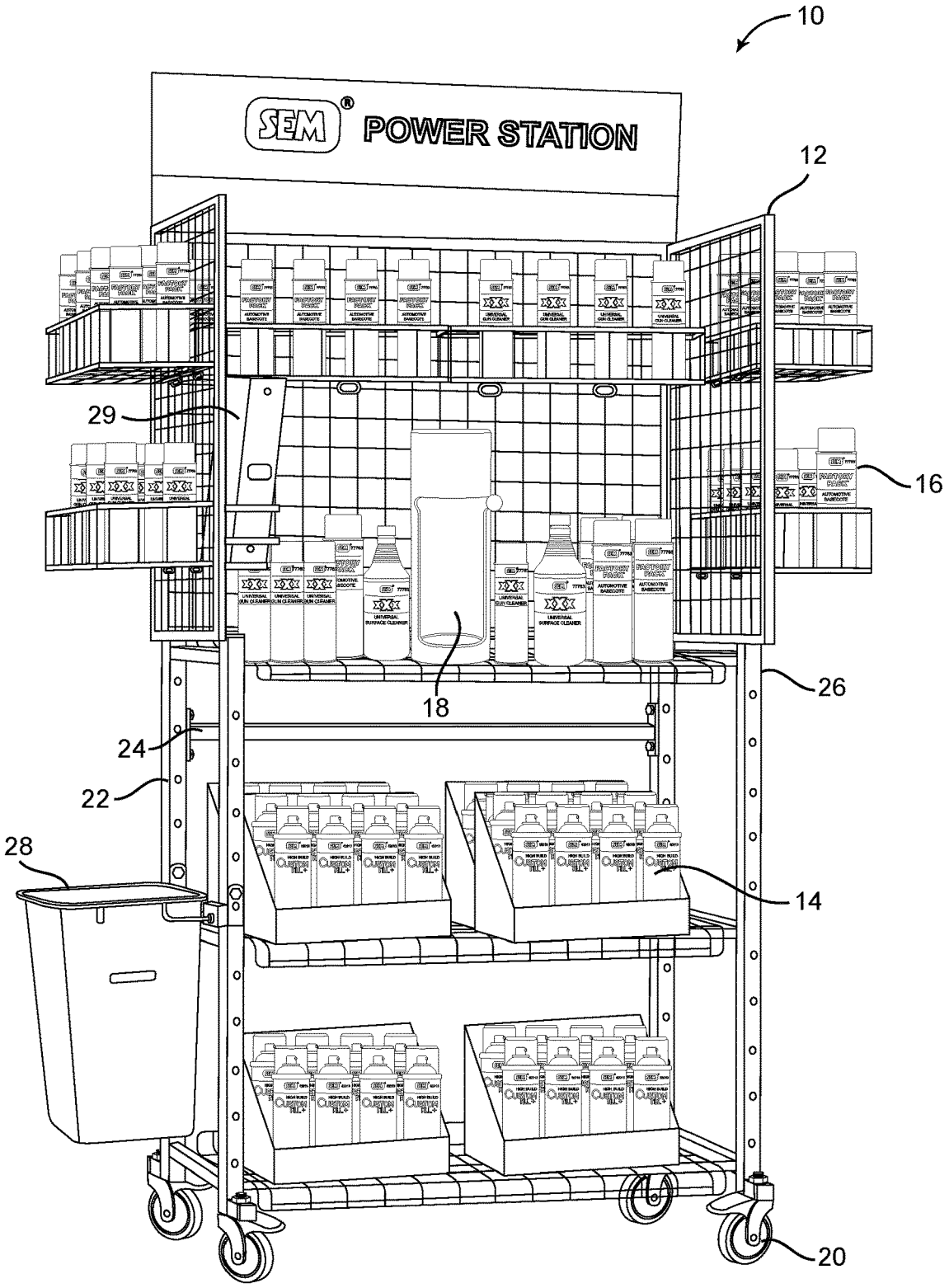
FIG. 1 is a perspective view of one exemplary embodiment of the paint and coating mixing kit of the present invention.

Referring now specifically to FIG. 1, in one exemplary embodiment, the present invention provides a point of service coating mixing and delivery kit and method. The kit 10 includes a shelf assembly 12 on (or cabinet assembly in) which aerosol blank cans 14, paint and coating cans or bottles 16, and a manual or pneumatic filling assembly 18 are disposed. The shelf assembly 12 may be modular and is provided with locking casters or wheels 20 such that it may be moved from place to place in the shop. In one exemplary embodiment, the shelf assembly 12 includes a plurality of vertical members 22 coupled to a plurality of horizontal members 24 via a plurality of welds, bolts, protrusion attachments, hook attachments, and/or the like. A plurality of shelves 26 are provided to hold the aerosol blank cans 14, paint and coating cans or bottles 16, and manual or pneumatic filling assembly 18. Thus, at least one of the plurality of shelves 26 has sufficient strength to support the filling assembly 18, which is preferably fixedly or removably attached to this shelf. It will readily apparent to those of ordinary skill in the art that any suitable shelf assembly 12 may be utilized, such as an open wire mesh rack system, a closed panel rack system, a cabinet system, etc. Preferably, the components of the shelf assembly 12 are manufactured from a sufficiently rigid material, such as a coated or uncoated metal, a plastic, or the like. Preferably, the shelf assembly 12 may be readily assembled and disassembled such that it may be conveniently shipped in one or more boxes. The shelf assembly 12 may also include hooks or receptacles for towels, a trash can 28, tools, instruction manuals 29, and/or the like.

The aerosol blank cans 14 disposed on the shelf assembly 12 are filled with a propellant and mixing marble (and optionally other universal paint or coating components, such as an activator or toner) and include a chosen spray tip and preferably come equipped with a cap. These aerosol blank cans 14 may be selectively filled with most desired water based or solvent based paints or coatings, such as a urethane basecoat, single stage, acrylic, or alkyd enamel, acrylic lacquer, etc. The paint and coating cans or bottles 16 may include any combination of desired paints, coatings, clearcoats, catalysts, activators, reducers, etc., whether water or solvent based, that are to be disposed in the aerosol blank cans 14 using the manual or pneumatic filling assembly 18. Thus, the blank cans 14 and contents bottles 16 collectively provide everything necessary to provide a sprayable paint or coating when combined.

Figure 2:
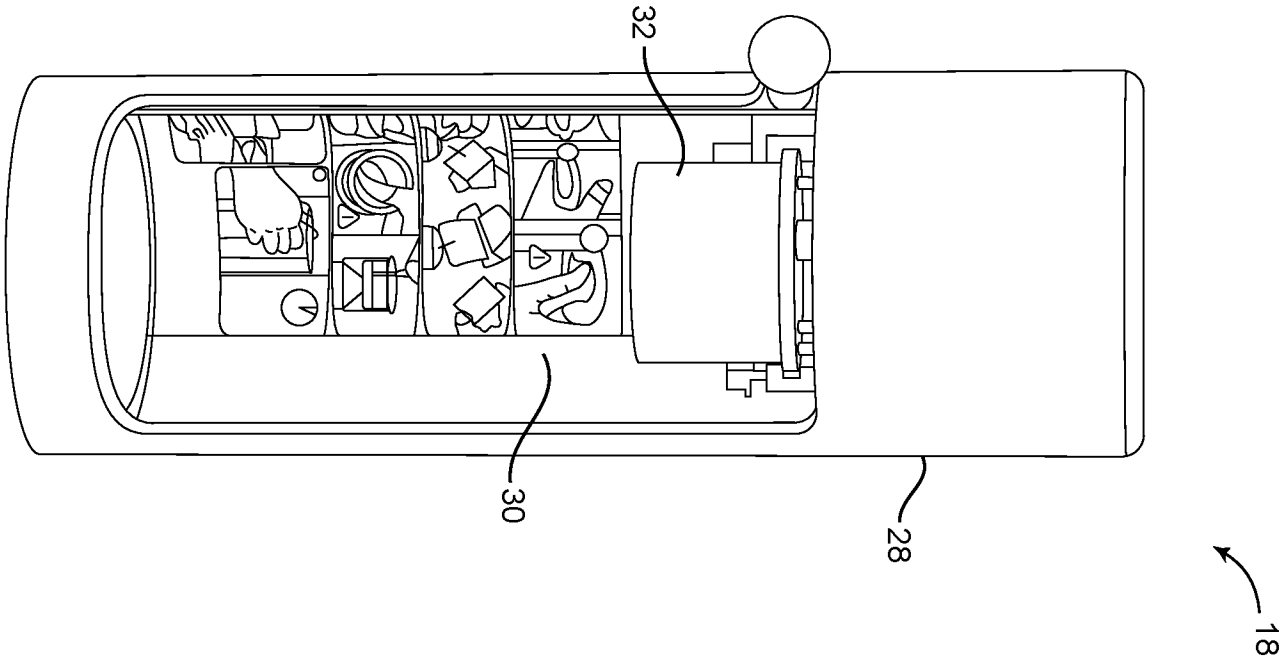
FIG. 2 is a perspective view of one exemplary embodiment of a filling assembly coupled to and utilized in the paint and coating mixing kit of the present invention.

Referring now specifically to FIG. 2, in one exemplary embodiment, the filling assembly 18 includes a rigid housing 28 defining an opening 30 in which one of the aerosol blank cans 14 (FIG. 1) is selectively disposed with the cap and spray tip removed. In this exemplary embodiment, a substantially cylindrical metallic housing 28 is shown. A filling cylinder or the like 32 filled with the desired paint or coating is also selectively disposed within or coupled to the rigid housing 28. The filling assembly 18, which is operated manually or coupled to an attached compressor (not illustrated), is actuated and injects the desired paint or coating into the aerosol blank can 14, which may then be removed and used in the shop. In essence, one or more coupling conduits direct the paint or coating from the filling cylinder 32 into the blank can 14 under a pressure gradient. Any number of coupling/sealing components may be provided for this purpose. The manually operated filling assembly 18 is operated by a hand crank (not illustrated), for example, that is actuated to drive the paint or coating into the blank can 14. The pneumatically operated filling assembly 18 is operated by actuating the compressor to drive the paint or coating into the blank can 14. Preferably, the compressor provides at least 120 psi, as indicated by an inline pressure gauge (not illustrated) or the like. This compressor may be disposed proximate to or remote from the pneimatically operated filling assembly 18. For example, a shop compressor may be used. This filling process may consist of one step or multiple steps. Such filling assemblies 18 are generally know to those of ordinary skill in the art, although have not been provided as in the present kit 10 (FIG. 1).

In general, the present invention allows for the point of service provision of ready-to-use aerosolized paints and coatings, without concerns related to spoilage or mess. For example, slower activators may be selectively used to maximize paint or coating shelf life. Of importance, the kit 10 (FIG. 1) of the present invention is sold as a unified workstation for use in an automobile paint shop or the like. Paints or other coating may be selected from the shelf assembly 12 and immediately delivered to the aerosol cans 14 for use onsite, in a convenient self-service manner, thereby freeing up worker resources for other tasks. The kit 10 is sold as a unified whole, initially including selected aerosol blank cans 14 (FIG. 1), selected paint and coating cans or bottles 16 (FIG. 1), and the manual or pneumatic filling assembly 18 (FIGS. 1 and 2). Supplemental components may later be purchased and integrated into the kit 10 as desired.

Although the present invention is illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following non-limiting claims.

What is claimed is:

1. A paint and coating mixing kit, comprising:

a shelf assembly;

a plurality of aerosol blank cans disposed on the shelf assembly;

a plurality of paint or coating cans or bottles disposed on the shelf assembly; and a filling assembly disposed on the shelf assembly;

wherein the filling assembly is operable for selectively delivering a paint or coating from one of the plurality of paint or coating cans or bottles to one of the plurality of aerosol blank cans at a point of service location such that the paint or coating may be delivered in spray form from the aerosol blank can to an object to be painted or coated at the point of service location; and wherein the shelf assembly comprises wheels or casters for allowing the shelf assembly, the plurality of aerosol blank cans, the plurality of paint or coating cans or bottles, and the filling assembly to move in unison in proximity to the point of service location.

2. The kit of claim 1, wherein the plurality of aerosol blank cans are configured to receive one of a water based paint or coating and a solvent based paint or coating.

3. The kit of claim 1, wherein the plurality of paint or coating cans or bottles comprise one or more components of one of a water based paint or coating, a solvent based paint or coating, an activated paint or coating, and a non-activated paint or coating.

4. The kit of claim 1, wherein the filling assembly comprises one of a manual filling assembly and a pneumatic assembly.

5. The kit of claim 4, wherein the pneumatic filling assembly comprises a coupled compressor operable for actuating the pneumatic filling assembly.

6. A method for providing a paint and coating mixing kit, comprising:

providing a shelf assembly;

providing a plurality of aerosol blank cans disposed on the shelf assembly;

providing a plurality of paint or coating cans or bottles disposed on the shelf assembly; and providing a filling assembly disposed on the shelf assembly;

wherein the filling assembly is operable for selectively delivering a paint or coating from one of the plurality of paint or coating cans or bottles to one of the plurality of aerosol blank cans at a point of service location such that the paint or coating may be delivered in spray form from the aerosol blank can to an object to be painted or coated at the point of service location; and wherein the shelf assembly comprises wheels or casters for allowing the shelf assembly, the plurality of aerosol blank cans, the plurality of paint or coating cans or bottles, and the filling assembly to move in unison in proximity to the point of service location.

7. The method of claim 6, wherein the plurality of aerosol blank cans are configured to receive one of a water based paint or coating and a solvent based paint or coating.

8. The method of claim 6, wherein the plurality of paint or coating cans or bottles comprise one or more components of one of a water based paint or coating, a solvent based paint or coating, an activated paint or coating, and a non-activated paint or coating.

9. The method of claim 6, wherein the filling assembly comprises one of a manual filling assembly and a pneumatic assembly.

10. The method of claim 9, wherein the pneumatic filling assembly comprises a coupled compressor operable for actuating the pneumatic filling assembly.

11. The method of claim 6, further comprising shipping the shelf assembly, the plurality of aerosol blank cans, the plurality of paint or coating cans or bottles, and the filling assembly to a user together in one or more boxes.

* * * * *